US006647214B2

(12) United States Patent
Takahashi

(10) Patent No.: US 6,647,214 B2
(45) Date of Patent: Nov. 11, 2003

(54) IMAGE FORMING APPARATUS AND CONTROL METHOD THEREFOR

(75) Inventor: Atsuya Takahashi, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/940,588

(22) Filed: Aug. 29, 2001

(65) Prior Publication Data

US 2002/0030845 A1 Mar. 14, 2002

(30) Foreign Application Priority Data

Aug. 31, 2000 (JP) ..... 2000-264352

(51) Int. Cl.[7] ..... G03G 15/00
(52) U.S. Cl. ..... 399/13; 399/25
(58) Field of Search ..... 399/13, 24, 25, 399/26, 27, 12, 9, 38, 262

(56) References Cited

U.S. PATENT DOCUMENTS 5,452,059 A * 9/1995 Sekiya ..... 399/25
5,708,912 A * 1/1998 Lee ..... 399/24
6,137,966 A * 10/2000 Uehara et al. ..... 399/13
2001/0016123 A1 * 8/2001 Yoshimura ..... 399/25

* cited by examiner

*Primary Examiner*—Sophia S. Chen
(74) *Attorney, Agent, or Firm*—Fitzpatrick, Cella, Harper & Scinto

(57) ABSTRACT

An engine control part starts data transmission to a non-volatile memory of a process cartridge. An opening/closing sensor continues to detect an opening or closing state of an upper door open and closed for attaching or detaching the process cartridge until the engine control part confirms that the data transmission is finished. If such a state that the door is open is detected, the engine control part halts the data transmission, and temporarily stores the data currently transmitted in a memory thereof. After that, when the upper door is closed and mounting of the process cartridge is confirmed, the engine control part re-executes the data transmission so that the data temporarily stored in the memory thereof will be re-transmitted.

13 Claims, 5 Drawing Sheets

IMAGE FORMING APPARATUS AND CONTROL METHOD THEREFOR

BACKGROUND OF THE INVENTION

1. Field of the Invention

The present invention relates to an image forming apparatus and a control method therefor, which feature control of input and output of data to a nonvolatile memory mounted in a process cartridge removable from the image forming apparatus.

2. Related Background Art

Modern image forming apparatuses such as laser printers, copiers and facsimiles can perform data transmission to a nonvolatile memory mounted in a process cartridge removable from the image forming apparatuses.

FIG. 5 is a flowchart illustrating a conventional method of transmitting data to a nonvolatile memory. In FIG. 5, it is detected in step 501 whether such condition that data transmission to a nonvolatile memory is needed takes place or not. If data transmission is needed, data transmission to the nonvolatile memory is started in step 502. Then, it is confirmed in step 503 whether the data transmission is finished. After that, the control procedure returns to step 501 from which the sequence of control operations is repeated.

However, the above-mentioned conventional method has the following drawbacks. In other words, data transmission to the nonvolatile memory becomes unstable when a door open and closed for attaching or detaching a process cartridge is opened during the data transmission to the nonvolatile memory mounted in the process cartridge. This runs the danger of losing part of data to be stored in the nonvolatile memory. Further, in the event that part of data is lost, there is no means for recognizing the data loss, which impairs the reliability of data stored in the nonvolatile memory.

SUMMARY OF THE INVENTION

The present invention has been made to solve the above-mentioned problems. It is an object of the present invention to provide an image forming apparatus and a control method therefor, capable of avoiding possibilities of any data loss even if, for example, a door is opened during data transmission to a nonvolatile memory mounted in a process cartridge. The image forming apparatus and its control method also enable restart of data transmission to a proper nonvolatile memory alone after closing the open door.

An image forming apparatus according to the present invention comprises: an attachment device as a functional member in image forming, removably attached at a predetermined position; an open-close member for opening and closing when the attachment device is attached or detached; a memory means mounted in the attachment device for storing data; a detection means for detecting opening and closing of the open-close member; and a control means for halting input and output operations of data to the memory means when opening of the open-close member is detected on the basis of the detection results of the detection means.

In the image forming apparatus and according to another aspect of the present invention, wherein the memory means has unique identification information, the control means stores the identification information read out of the memory means, the control means halts the data transmission to the memory means when opening of the open-close member is detected during data transmission to the memory means on the basis of the detection results of the detection means, while the control means includes a temporary memory means for storing the data concerned, the control means reads the identification information out of the memory means to compare the read-out identification information with the identification information stored in the temporary memory means before the open-close member is open when the open-close member is closed again, and the control means re-executes the data transmission to the memory means if both pieces of identification information correspond to each other.

In the image forming apparatus and according to still another aspect of the present invention, the memory means has unique identification information, the control means stores the identification information read out of the memory means, the control means halts the data transmission to the memory means when opening of the open-close member is detected during data transmission to the memory means on the basis of the detection results of the detection means, while the control means includes a temporary memory means for storing the data concerned, the control means reads the identification information out of the memory means to compare the read-out identification information with the identification information stored in the temporary memory means before the open-close member is open when the open-close member is closed again, and the control means deletes the data stored in the temporary memory means and writes the read-out identification information over the identification information stored in the temporary memory means if both pieces of identification information do not correspond to each other.

In the image forming apparatus and according to yet another aspect of the present invention, the memory means has unique identification information, the control means stores the identification information read out of the memory means, and the control means halts the data transmission to the memory means when opening of the open-close member is detected during data transmission to the memory means on the basis of the detection results of the detection means, while the control means includes a temporary memory means for storing the data concerned, the control means reads the identification information out of the memory means to compare the read-out identification information with the identification information stored in the temporary memory means before the open-close member is open when the open-close member is closed again, and the control means deletes the data stored in the temporary memory means and generates a signal indicative of failure of the data transmission if both pieces of identification information do not correspond to each other.

Another image forming apparatus according to the present invention is capable of removably mounting therein a replacement unit having a memory means, the apparatus comprising: an open-close member for opening and closing when the replacement unit is attached or detached; a detection means for detecting opening and closing of the open-close member; and a control means for controlling input and output operations of data to the memory means, wherein the control means includes a temporary memory means such that when the control means confirms a signal sent from the detection means during data transmission to the memory means, detects such a state that the open-close member is open, and stores the data concerned in the temporary memory means.

A control method for an image forming apparatus according to the present invention, in which the image forming apparatus includes an attachment device as a functional member in image forming, removably attached at a predetermined position, an open-close member for opening and closing when the attachment device is attached or detached, and a memory means for storing data, mounted in the attachment device, comprises the steps of: detecting opening and closing of the open-close member; and halting input and output operations of data to the memory means when opening of the open-close member is detected in the detection step.

In the control method and according to another aspect of the present invention, the memory means has a storage area for storing unique identification information, and the control method comprises the steps of: detecting opening and closing of the open-close member during input and output operations of data to the memory means; halting the data transmission and storing in a temporary memory means the data currently transmitted when opening of the open-close member is detected in the detection step; reading the identification information out of the memory means when then closing of the open-close member is detected in the detection step; and comparing the read-out identification information with the identification information stored in the temporary memory means before the open-close member is open, and re-executing the data transmission to the memory means if both pieces of identification information correspond to each other.

In the control method and according to still another aspect of the present invention, the memory means has a storage area for storing unique identification information, and the control method comprises the steps of: detecting opening and closing of the open-close member during data transmission to the memory means; halting the data transmission and storing in a temporary memory means the data currently transmitted when opening of the open-close member is detected in the detection step; reading the identification information out of the memory means when then closing of the open-close member is detected in the detection step; and comparing the read-out identification information with the identification information stored in the temporary memory means before the open-close member is open, and deleting the data stored in the temporary memory means and writing the read-out identification information over the identification information stored in the temporary memory means if both pieces of identification information do not correspond to each other.

In the control method and according to yet another aspect of the present invention, the memory means has a storage area for storing unique identification information, and the control method comprises the steps of: detecting opening and closing of the open-close member during data transmission to the memory means; halting the data transmission and storing in a temporary memory means the data currently in input and output operations when opening of the open-close member is detected in the detection step; reading the identification information out of the memory means when then closing of the open-close member is detected in the detection step; and comparing the read-out identification information with the identification information stored in the temporary memory means before the open-close member is open, and deleting the data stored in the temporary memory means and notifying the user of the image forming apparatus of failure of the data transmission if both pieces of identification information do not correspond to each other.

According to the present invention, opening and closing of the open-close member can be so detected as to properly control input and output operations of data to the memory means mounted in the attachment device. The attachment device is a functional member in image forming, placed in position. This makes it possible to eliminate losses of data to be stored in the memory means, and even if part of data is lost, the user can be informed of the occurrence of the data loss.

These and other objects and advantages of the invention may be readily ascertained by referring to the following description and appended drawings as follows.

DETAILED DESCRIPTION OF THE PREFERRED EMBODIMENTS

Hereinbelow, preferred embodiments of the present invention will be described in detail with reference to the accompanying drawings.

First Embodiment

Figure 1:
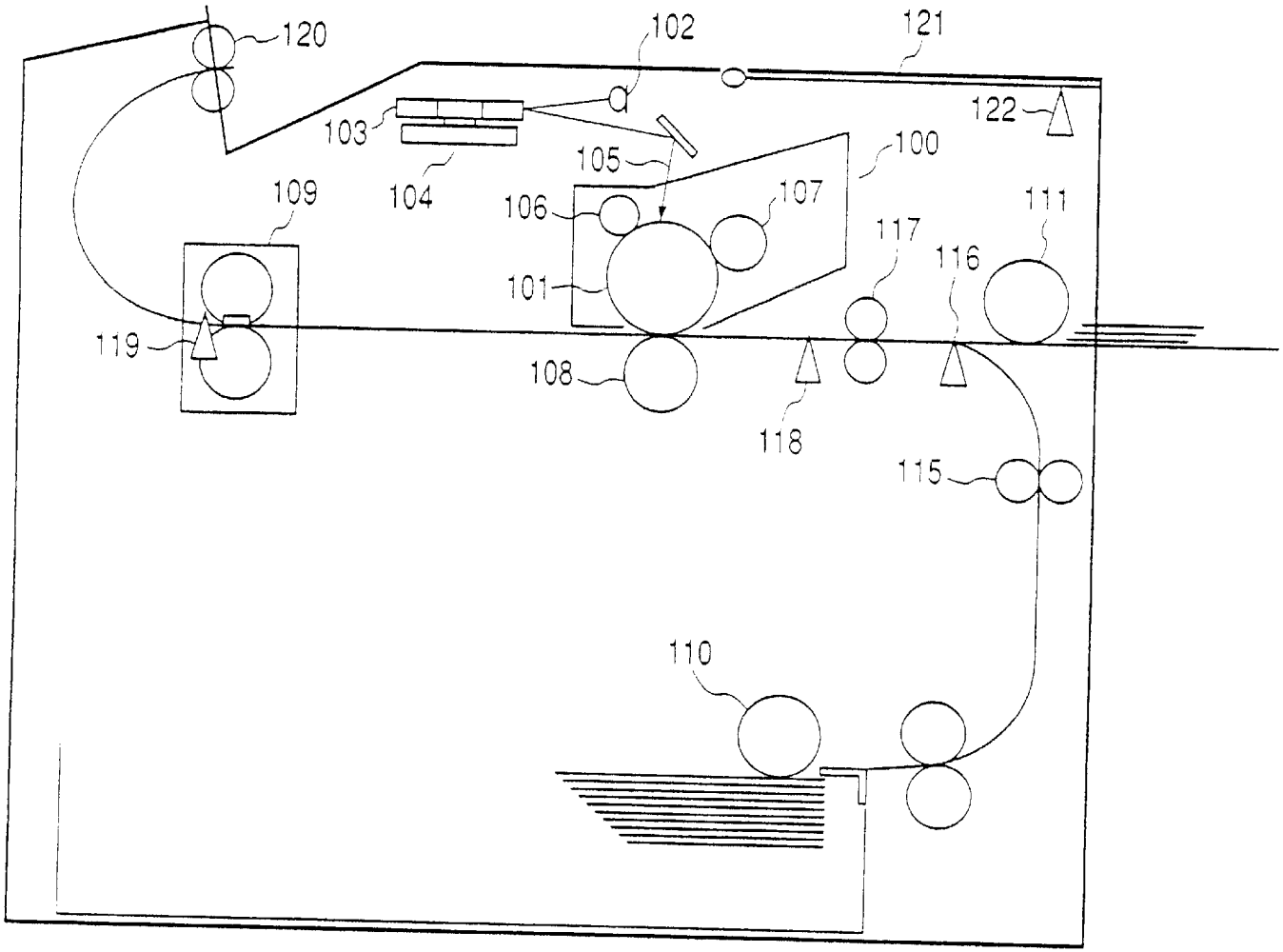
FIG. 1 is a mechanical drawing illustrating a schematic configuration of a laser beam printer according to the p resent invention.

A description will be provided below about a printer as an example of an image forming apparatus. The printer has features or mechanics as shown in FIG. 1. As shown, the printer includes a process cartridge 100 removable from the printer, a photosensitive drum 101 incorporated in the process cartridge 100 as an electrostatic carrier, a semiconductor laser 102 as a light source, and a rotary polyhedral mirror 103 driven by a scanner motor 104 to rotate. A laser beam 105 is emitted from the semiconductor laser 102 so that the surface of the photosensitive drum 101 will be scanned therewith.

A charging roller 106 uniformly charges or electrifies the surface of the photosensitive drum 101, and a developing device 107 develops an electrostatic latent image formed on the photosensitive drum 101 to form a toner image. A transfer roller 108 transfers the toner image developed by the developing device 107 to a given recording sheet, and a fixing device 109 fuses toner transferred to the recording sheet. The process cartridge 100 incorporates therein the photosensitive drum 101, the charging roller 106 and the developing device 107.

A sheet feeding roller 110 feeds a sheet from a cassette, capable of identifying the size of the recording sheet, to a conveying path. A manual sheet feeding roller 111 feeds a sheet from a manual feed slot, incapable of identifying the size of the recording sheet, to the conveying path. A conveying roller 115 conveys the sheet fed from the cassette.

A pre-feed sensor 116 detects the leading and trailing ends of the fed sheet. A pre-transfer roller 117 feeds the conveyed sheet to the photosensitive drum 101. A top sensor 118 is provided to not only synchronize image writing onto the photosensitive drum 101 with the conveyance of the sheet, but also to measure the length of the fed sheet in the sheet conveying direction. A sheet discharging sensor 119 senses the sheet discharged to the outside of the apparatus after the toner image has been fixed on the sheet. A sheet discharging roller 120 discharges the sheet from the fixing device onto an FD tray. An upper door 121 is opened and closed when the removable process cartridge 100 is attached or detached from the apparatus. An opening/closing sensor 122 senses opening and closing of the upper door 121.

Figure 2:
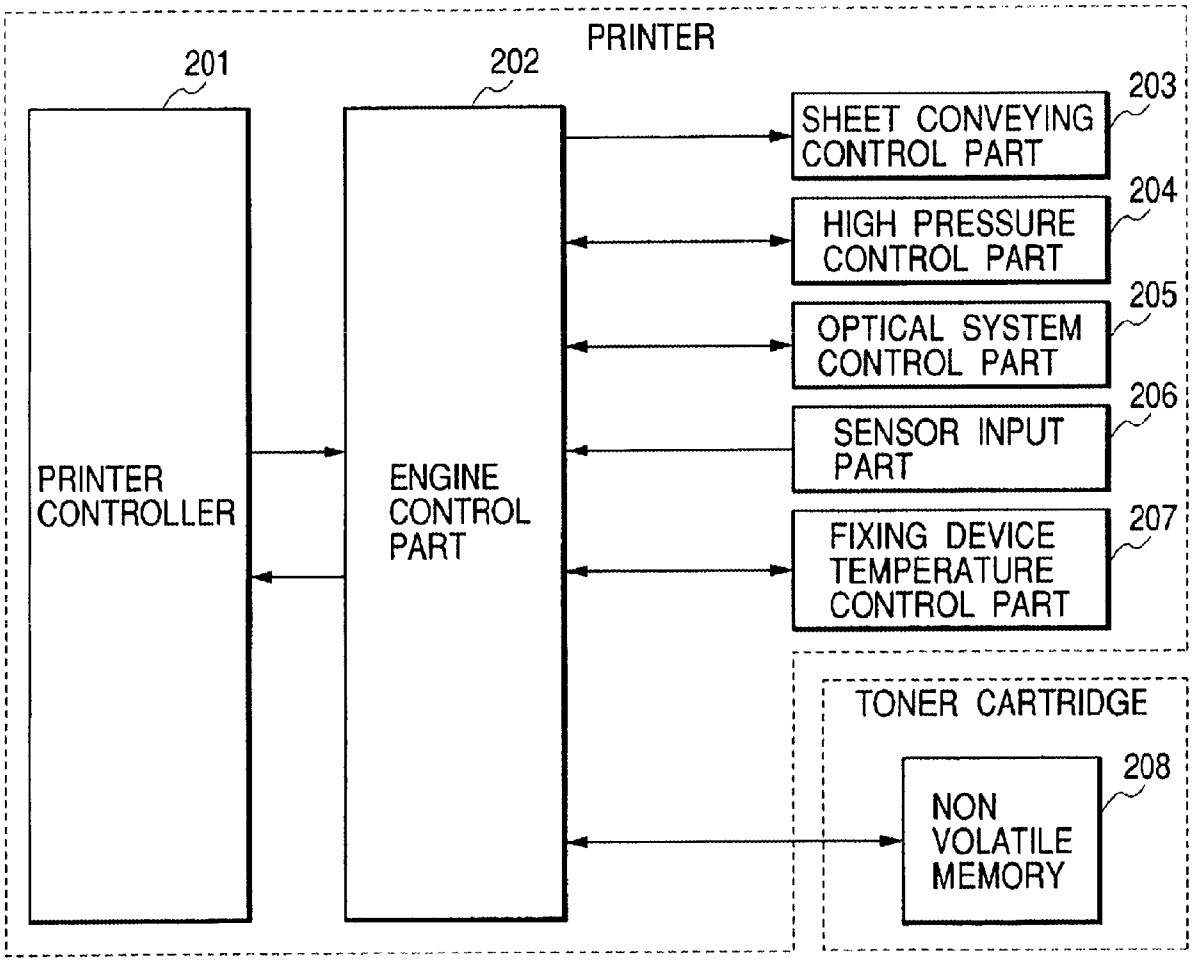
FIG. 2 is a block diagram illustrating control circuitry of the laser beam printer.
Figure 3:
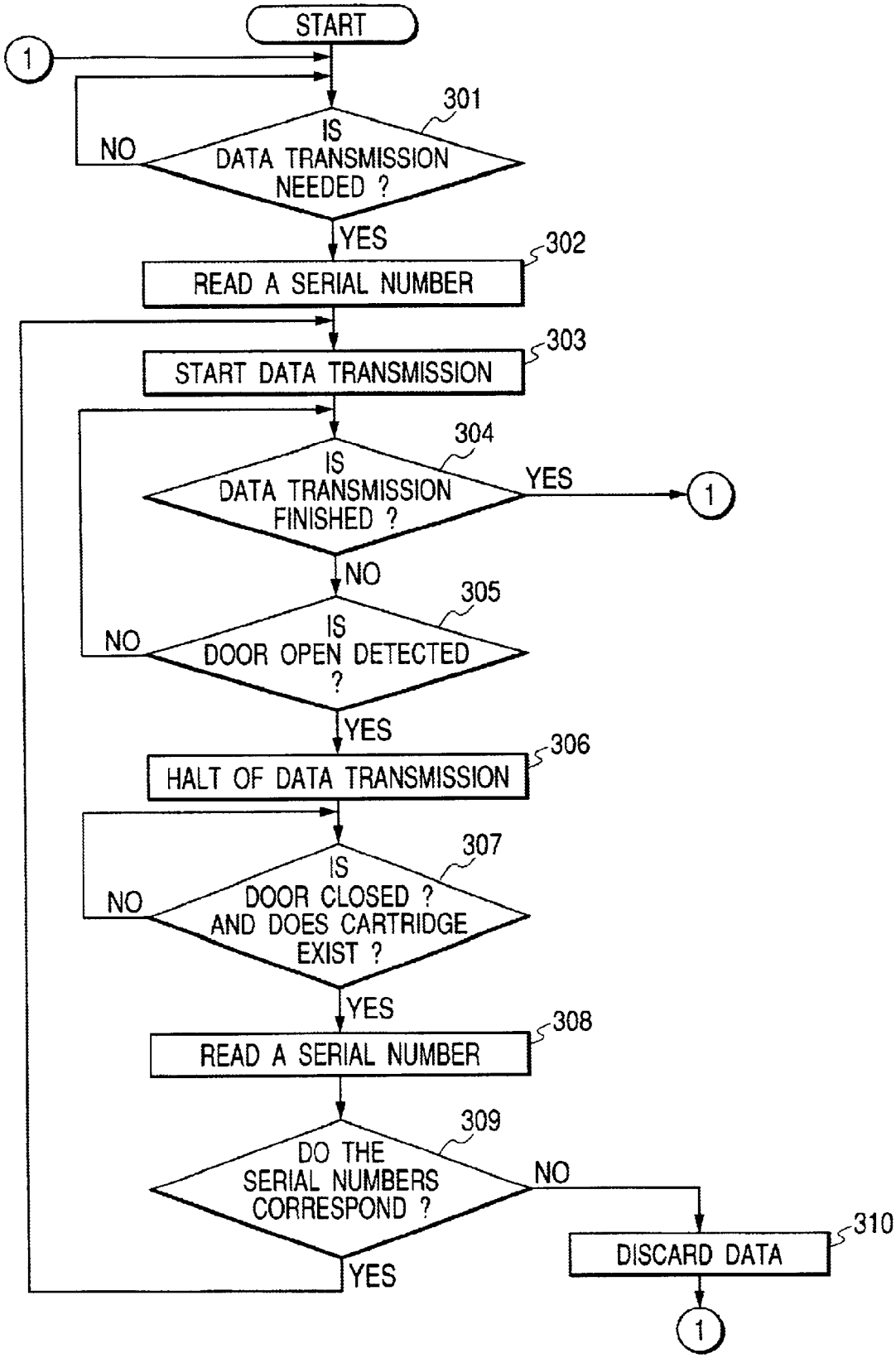
FIG. 3 is a flowchart illustrating control procedures according to a first embodiment of the present invention.

FIG. 2 is a block diagram illustrating control circuitry for controlling the above mentioned mechanism. In FIG. 2, a printer controller 201 expands image code data sent from external equipment such as a host computer, not shown, as bit data suitable in format for printing on the printer. The printer controller 201 also reads out internal information on the printer to make a display of the internal information. A printer engine-control part 202 controls the operation of each part of a printer engine, to be described later, in accordance with instructions from the printer controller 201. The printer engine-control part 202 also communicates with the printer controller 201 about the internal information on the printer. The printer engine-control part 202 includes a CPU, a RAM which provides a work area for the CPU, and a ROM for storing control procedures executed by the CPU for controlling each part of the printer engine, and control procedures as shown in FIG. 3. A sheet conveying control part 203 carries out driving and stopping of the motor and rollers so that a recording sheet will be conveyed properly in accordance with instructions from the printer engine-control part 202. A high pressure control part 204 carries out control of high pressure output in each process such as charging, development or transfer process in accordance with instructions from the printer engine-control part 202. An optical system control part 205 controls driving and stopping of the scanner motor 104 and turning on the laser beam in accordance with instructions from the printer engine-control part 202. A sensor input part 206 enters signals from sensors such as the pre-feed sensor, the top sensor, the sheet discharging sensor and the opening/closing sensor. The signals are input to the engine control part 202. A fixing device temperature-control part 207 carries out actuation/stopping of energization to a fusing heater in accordance with instructions from the printer engine-control part 202.

A nonvolatile memory 208 is incorporated in the process cartridge 100 removable from the printer so that data related to usage patterns of the process cartridge will be stored in the nonvolatile memory 208.

FIG. 3 illustrates control procedures for data transmission to the nonvolatile memory removable from the process cartridge and data recovery when the door is open as practiced in the embodiment.

In FIG. 3, it is always checked in step 301 whether such a case that data related to usage patterns of the process cartridge need to be transmitted to the nonvolatile memory 208 mounted in the process cartridge takes place. Here, the usage patterns include the amount of residual toner, the rotation number or time of the photosensitive drum, and the number of printed sheets. This determination of whether data transmission is needed is made, for example, by detecting the occurrence of a change in usage patterns of consumable members in the process cartridge as a result of printing operations on the image forming apparatus. If the data transmission is needed, a serial number uniquely stored on a specific area of the nonvolatile memory 208 is read out in step 302. The serial number will not need reading out if it has already been read out, for example, at turn-on or when the process cartridge was replaced with new one. The serial number read out in step 302 is stored in the memory (RAM) of the engine control part 202. Then, in step 303, data transmission to the nonvolatile memory 208 is started as required. After that, if it is confirmed in step 304 that the data transmission is finished, it is determined that the data transmission is finished normally, and the control procedure returns to step 301 again and the sequence of operations is repeated from step 301.

The opening/closing sensor 122 continues to detect in step 305 an opening or closing state of the upper door 121 open and closed for attaching or detaching the process cartridge until it is confirmed in step 304 that the data transmission is finished. If such a state that the door is open is not detected, it is confirmed in step 304 again whether the data transmission is finished. On the other hand, if such a state that the door is open is detected in step 305, the process cartridge 100 might be pulled out of the image forming apparatus, which runs the danger of failure of normal data transmission to the nonvolatile memory. In this case, the data transmission is halted in step 306, and the data currently transmitted are temporarily stored in the memory of the engine control part 202.

After that, if it is confirmed in step 307 that the upper door 121 is closed and the process cartridge 100 is attached, a serial number unique to each nonvolatile memory mounted in the process cartridge 100 is read out in step 308. Then, in step 309, the read-out serial number is compared with the serial number read out in step 302 and stored in the memory of the engine control part 202. If the comparison result shows that both serial numbers correspond to each other, it is determined that the newly mounted process cartridge is the same as the process cartridge mounted before opening and closing of the door. In this case, the data transmission operations is re-executed from step 303 so that the data temporarily stored in the memory of the engine control part 202 will be re-transmitted.

On the other hand, if both serial numbers do not correspond to each other, it is determined that a new process cartridge different from the process cartridge mounted before opening and closing of the door has been attached. In this case, the data temporarily stored in the memory of the engine control part 202 are discarded, and the new serial number is written over the serial number stored in the memory in step 302.

As described above and according to the first embodiment of the present invention, even if the door is opened during data transmission, the data can be managed with the serial number unique to each nonvolatile memory to recover data transmission when the process cartridge is attached again. Therefore, data losses can be prevented or minimized.

It should be noted that the above-mentioned embodiment described the serial number unique to each nonvolatile memory for identifying the process cartridge, the present invention is not limited thereto, and any other information may be used as long as it can identify the process cartridge.

Second Embodiment

Next, second embodiment of the present invention will be described with reference to FIG. 4.

The apparatus mechanism in this embodiment is equivalent to that of the first embodiment, and description thereof will be omitted. Further, the circuit structure in this embodiment is the same as that of the first embodiment, and description thereof will also be omitted.

Figure 4:
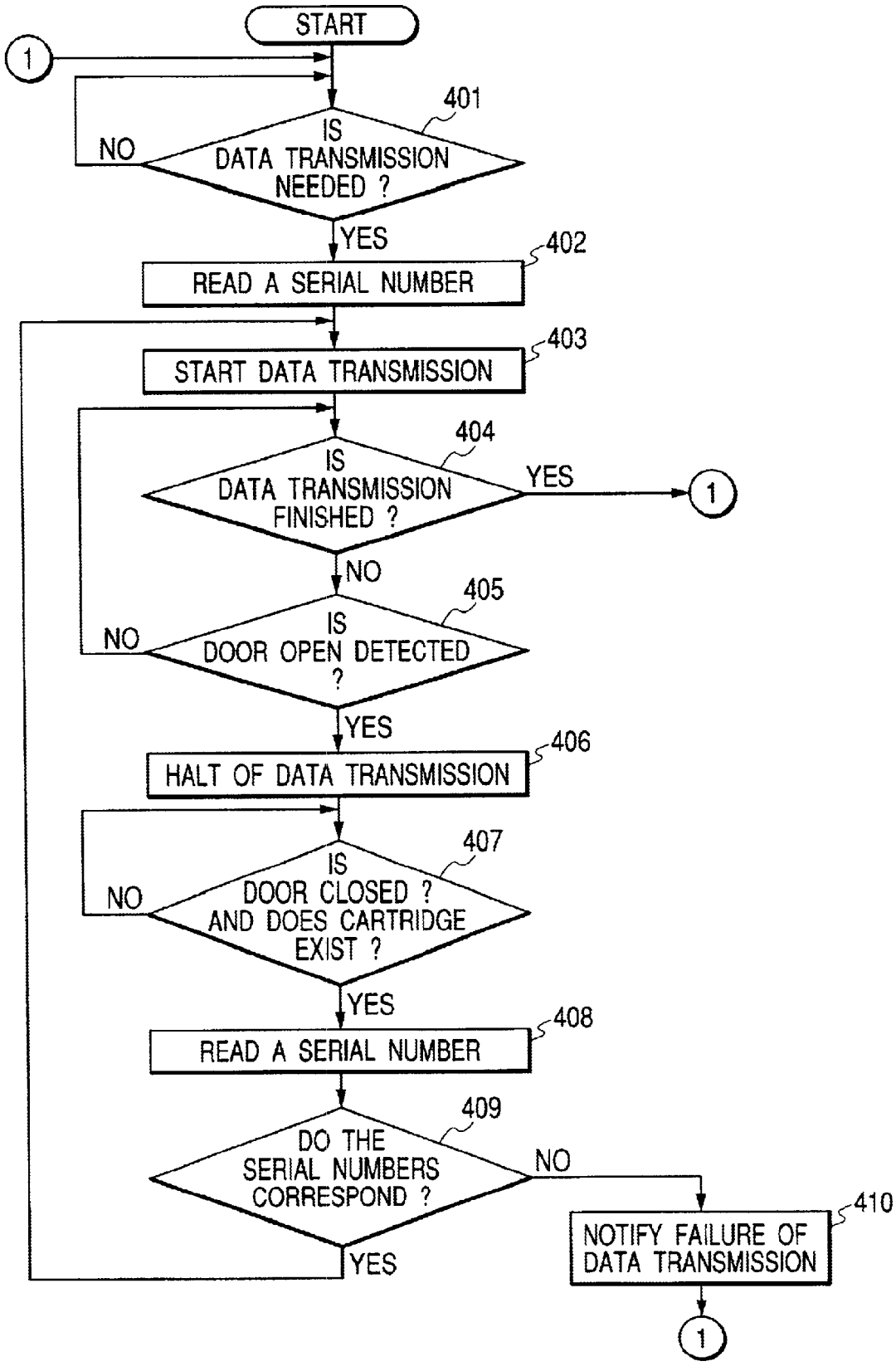
FIG. 4 is a flowchart illustrating control procedures according to a second embodiment of the present invention.
Figure 5:
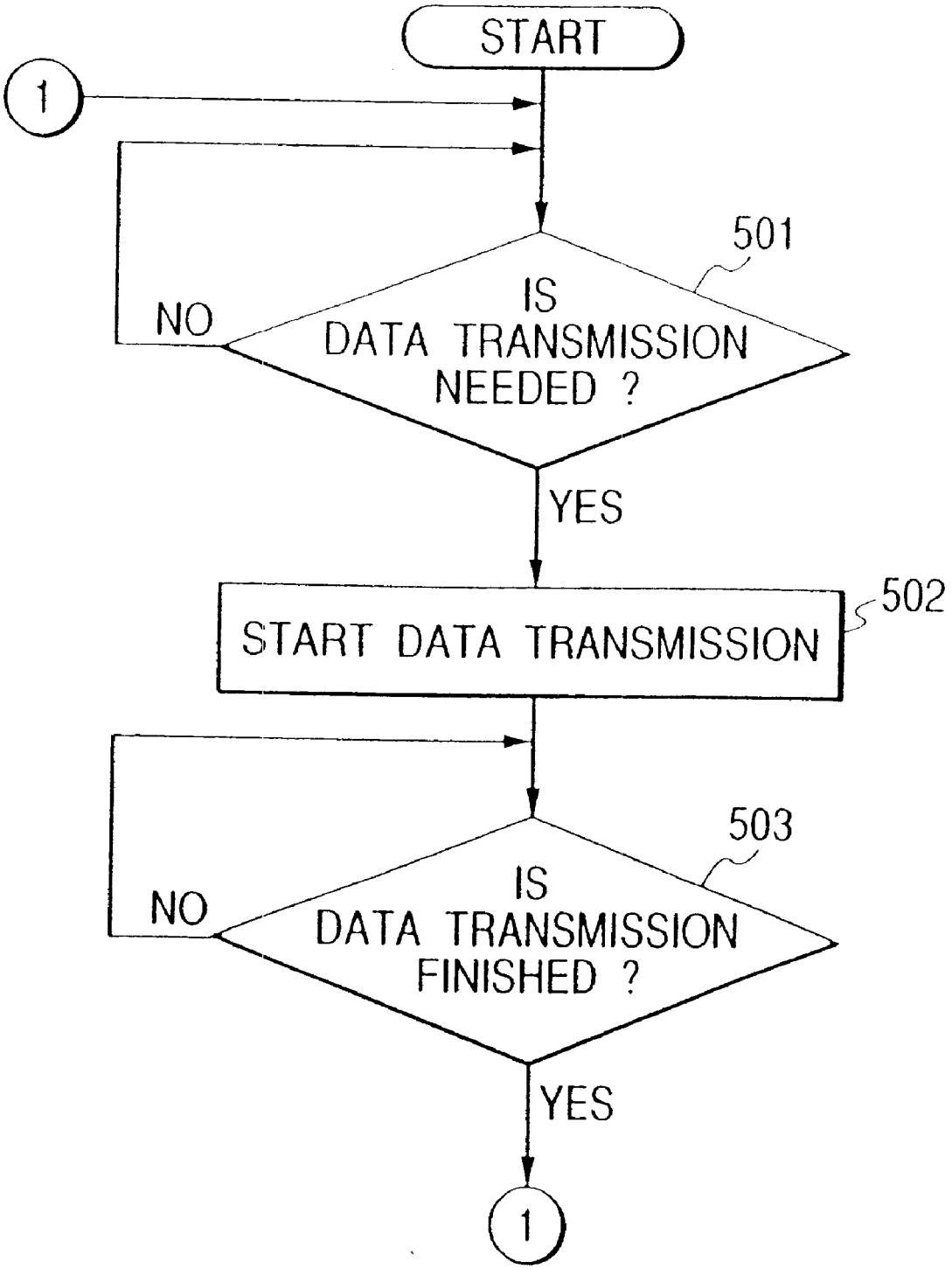
FIG. 5 (PRIOR ART)
FIG. 5 is a flowchart illustrating conventional control procedures.

FIG. 4 is a flowchart related to a method of transmitting data to the nonvolatile memory 208 according to the second embodiment of the present invention. In this flowchart, processing steps 402 and 409 are the same as step 302 and 309 in FIG. 3 with description of these steps being omitted.

In FIG. 4, it is confirmed in step 401 whether the printer controller 201 instructs data transmission to the nonvolatile memory 208. Then, in step 409, if both serial numbers do not correspond to each other, it is determined that a process cartridge different from the process cartridge mounted before opening and closing of the door has been attached. In this case, the engine control part 202 discards the data temporarily stored in the memory thereof, and then, in a step 410, the engine control part 202 sends a signal for notifying the printer controller 201 of failure of the data transmission. Upon receipt of the notification, the printer controller 201 in turns notifies the user of the failure through a display panel or the like, not shown, as required, to urge the user to reattach the process cartridge that was originally mounted.

As described above and according to the second embodiment of the present invention, even if the door is open during data transmission, the data can be managed with the serial number unique to each nonvolatile memory to recover data transmission when the process cartridge is attached again. Therefore, data losses can be prevented or minimized, and even if part of data is lost, the user can be notified of the occurrence of the data loss.

Although the invention has been described in its preferred form with a certain degree of particularity, it is understood that the present disclosure of the preferred form has been changed in the details of construction and the combination and arrangement of the parts may be resorted to without departing from the spirit and the scope of the invention as herein claimed.

What is claimed is:

1. An image forming apparatus, to which an attachment device as a functional member in image forming is removably attachable, the attachment device having memory means for storing identification information and data transmitted from said image forming apparatus, said image forming apparatus comprising:

an open-close member to be opened and closed for attaching and detaching the attachment device:

a detection means for detecting opening and closing of said open-close member; and a control means for controlling data transmission to the memory means, wherein said control means halts data transmission to the memory means when opening of said open-close member is detected during data transmission to the memory means on the basis of the detection results of said detection means, and wherein when closing of said open-close member is detected by said detecting means after a halt of the data transmission due to the opening of said open-close member, said control means restarts the data transmission halted due to the opening of said open-close member provided that identification information stored in the memory means of the attachment device attached to said image forming apparatus is identical with identification information stored in the memory means of the attachment device before the halt of the data transmission.

2. An apparatus according to claim 1, wherein the attachment device is a process cartridge having at least either a photosensitive drum or a developing device.

3. An apparatus according to claim 1, wherein the memory means is a nonvolatile memory.

4. An apparatus according to claim 1, wherein the identification information is a serial number stored in the memory means.

5. An apparatus according to claim 1, wherein said control means comprises temporary means, in the case that data transmission is halted, for storing the data undergoing the data transmission.

6. An apparatus according to claim 5, wherein said control means discards data stored in the temporary means, which is in the data transmission, in the case that the identification information stored in the memory means of the attachment device attached to said image forming apparatus is not identical with the identification information stored in the memory means of the attachment device before the halt of the data transmission.

7. An apparatus according to claim 6, wherein said control means generates a signal indicative of failure of the data transmission as well as discards the data, which is in the data transmission.

8. A control method for an image forming apparatus including an attachment device as a functional member in image forming and an open-close member to be opened and closed for attaching and detaching said attachment device, the attachment device having memory means for storing identification information and data transmitted from the image forming apparatus, said control method comprising the steps of:

detecting opening and closing of the open-close member during data transmission to the memory means;

halting the data transmission to the memory means when opening of the open-close member is detected;

detecting closing of said open-close member; and restarting the data transmission halted due to the opening of the open-close member provided that identification information stored in the memory means of the attachment device attached to the image forming apparatus is identical with identification information stored in the memory means of the attachment device before the halt of the data transmission.

9. A method according to claim 8, further comprising a step of discarding the data, which is in the data transmission, provided that the identification information stored in the memory means of the attachment device attached to the image forming apparatus is not identical with the identification information stored in the memory means of said the device before the halt of the data transmission.

10. A method according to claim 9, further comprising a step of generating a signal indicative of failure of the data transmission as well as discarding the data, which is in the data transmission.

11. An image forming apparatus capable of removably mounting therein a replacement unit having a memory means, said image forming apparatus comprising:

an open-close member to be opened and closed for mounting and dismounting the replacement unit;

a detection means for detecting opening and closing of the open-close member; and a control means for controlling data transmission to the memory means, said control means including a temporary memory means, wherein when opening of said open-close member is detected by said detection means during the data transmission to the memory means, said control means stores the data, which is in the data transmission, into said temporary memory means.

12. An apparatus according to claim 11, wherein thereafter, when closing of said open-close member is detected by said detection means, said control means restarts transmitting data by transmitting data stored in said temporary memory means.

13. An image forming apparatus, to which an attachment device as a functional member in image forming is removably attachable, said attachment device having a memory for storing identification information and data transmitted from said image forming apparatus, said image forming apparatus comprising:

an open-close member to be opened and closed for attaching and detaching the attachment device;

a detection member which detects opening and closing of said open-close member; and a control unit for controlling data transmission to the memory and reading out identification information in the memory, wherein said control unit halts data transmission to said memory when opening of said open-close member is detected during data transmission to said memory on the basis of the detection results of said detection means, and wherein, when closing of said open-close member is detected by said detecting member after halting of the data transmission due to the opening of said open-close member, said control unit restarts the data transmission halted due to the opening of the open-close member, provided that identification information read out after said open-close member is closed is identical with the identification information read out before the data transmission is halted.

* * * * *

UNITED STATES PATENT AND TRADEMARK OFFICE

CERTIFICATE OF CORRECTION

PATENT NO. : 6,647,214 B2
DATED : November 11, 2003
INVENTOR(S) : Atsuya Takahashi It is certified that error appears in the above-identified patent and that said Letters Patent is hereby corrected as shown below:

Column 4,
Line 13, “p” should be deleted.
Line 14, “resent” should read -- present --.

Column 7,
Line 38, “device:” should read -- device; --.

Column 8,
Lines 2 and 7, “means,” should read -- memory means, --.

Column 10,
Line 5, “means,” should read -- member, --.

Signed and Sealed this

Thirteenth Day of July, 2004

JON W. DUDAS
*Acting Director of the United States Patent and Trademark Office*